United States Patent [19]

Dunn

[11] Patent Number: 4,888,573

[45] Date of Patent: Dec. 19, 1989

[54] FUSE CONSTRUCTION

[75] Inventor: Glen A. Dunn, Fairview, N.C.

[73] Assignee: Cooper Industries, Inc., Houston, Tex.

[21] Appl. No.: 287,906

[22] Filed: Dec. 21, 1988

[51] Int. Cl.[4] ..... H01H 71/20; H01H 85/04

[52] U.S. Cl. ..... 337/164; 337/165

[58] Field of Search ..... 337/163, 164, 165, 166

[56] References Cited

U.S. PATENT DOCUMENTS 2,111,749 3/1938 Bussmann ..... 337/164

2,688,677 9/1954 Laing ..... 337/164

3,122,619 2/1964 Fister ..... 337/164

4,562,420 12/1985 Kowalik et al. ..... 337/164

*Primary Examiner*—H. Broome

*Attorney, Agent, or Firm*—David A. Rose; Donald J. Verplancken

[57] ABSTRACT

A dual element cylindrical line fuse includes an insulating assembly disposed midway along an insulating tube. A metal eyelet having a barrel with a closed end is disposed through the assembly and retains an electrically conductive coil in place around the insulator assembly. A pair of heater strips extend between the ends of the coil and conductive end caps disposed on the ends of the tube.

23 Claims, 2 Drawing Sheets

FUSE CONSTRUCTION

BACKGROUND OF THE INVENTION

This invention pertains to the field of electrical circuit protectors, and more particularly to the field of dual element cylindrical line fuses.

Electrical circuit protectors, or fuses, are used in electric circuits to protect equipment from electric overload conditions. The fuse is placed in a power supply circuit adjacent the equipment to be protected, and will open the circuit to interrupt the flow of power to the equipment under prescribed current overload conditions. Such overloads could occur from a surge in line amperage caused by many factors, including a short circuit condition in the equipment to be protected.

One common protector is the cylindrical dual element line fuse. Prior art line fuses generally include a thin-walled, hollow insulating sleeve or tube having conductive end caps disposed on the ends of the tube and a conductive element or series of elements disposed within the tube between the conductive end caps. The conductive ends fit into clip terminals in the power supply circuit to permit the fuse to complete an electric circuit. During normal circuit conditions, current flows through the fuse without interruption. However, during overload conditions, the conductor fusing element forming a link in the conductive path overheats and melts, causing the element to sever, thereby preventing current flow through the fuse and opening the circuit.

The typical dual element fuse may have two separate fusing elements for initiation of fuse opening. One element, a strip and spring assembly, responds to long-term slight-to-moderate overcurrent conditions. The second element, a short circuit strip, opens the fuse in response to short circuit conditions. These separate fuse elements are connected in series to complete a conductive electrical path through the fuse body. The strip and spring assembly is comprised of a heater strip and a spring loaded in tension. One end of the heater strip of the strip and spring assembly is placed in electrical contact with one end cap. The short circuit strip is placed in electrical contact with the other end cap. The heater strip and the short circuit strip are threaded through the sleeve, and are connected to opposed ends of a conductive heater coil located on an insulator assembly housed near the center of the fuse. The insulator assembly divides the sleeve into two cavities. The cavity within which the short circuit strip is located is loaded with electric arc quenching filler such as sand, and the cavity in which the heater strip is located has air. Each cavity is substantially sealed to the environment exterior the fuse. The insulator assembly has a hollow aperture therethrough which forms a channel through which the arc quenching filler can travel between the two cavities. If too much of the filler material migrates through the channel, the arc quenching property of the silicates surrounding the short circuit strip is diminished, and the heat sink mass adjacent the heater coil is increased, thereby diminishing the effectiveness and safety of the fuse. To prevent migration, a washer is placed over the aperture in the assembly insulator.

The typical insulator assembly includes a cylinder having a separate insulator flange disposed on one end. The insulator flange includes a circular aperture at its center which is coaxially aligned with the bore of the cylinder. A coil of heat generating resistance wire is disposed about the exterior of the cylinder. A metal conductive hollow cylindrical eyelet, having an integral metal flange at one end, is disposed within the cylinder with the metal flange abutting the end of the cylinder opposite the cylinder-insulator flange interface. The end of the eyelet protrudes through the cylinder and aperture in the flange and the edge of the end of the eyelet is then roll crimped, retaining the cylinder and flange in contact. This maintains the coil in place between the insulator flange and metal flange. One end of the coil is bent, by hand using a pair of pliers, over the outer edge of the metal flange prior to assembly of the eyelet into the cylinder. After assembly, the opposite end of the coil protrudes through the insulator flange. The strip and spring assembly are connected to the metal flange by a solder like fusing alloy. The fusing alloy has a specific preselected melting point capable of being generated by the buildup of heat within the heater coil caused by the movement of long-term excess current through the fuse. The ends of the short circuit strip and strip and spring assembly are oppositely disposed to the conductive end caps. Thus, an electrical path is created, from one conductive cap, through the short circuit strip, coil, strip and spring assembly and into the opposed conductive cap.

The two fusing elements are held in place in the tube by the end caps. The heater strip portion of the strip and spring assembly is held by a retainer placed between one end cap and the end of the tube. The retainer holds the heater strip in conductive contact with the end cap. The spring is held in tension by a hanger placed across the end of the insulating tube. The short circuit strip is retained in electrically conductive contact with the other end cap through a circular slotted conductive washer housed in the end cap. The end of the short circuit strip is passed through the slot in the washer, and the washer is retained between the end cap and sleeve end. The heater strip in the strip and spring assembly and the short circuit strip are normally made from the same materials. However, the heater strip has a greater cross-sectional area than the short circuit strip.

The insulator assembly is located in the tube by a series of notches punched into the outer periphery of the tube thereby creating protrusions on the inner surface of the tube. The insulator flange engages these protrusions and is held against them by the tension of the spring.

In operation, normal electrical current, i.e., fuse-rated current, flows through the fusing elements. However, the fuse will sever and open under two conditions: a short circuit or a long-term overload condition. In a short circuit condition, the electric current passing through the fuse is substantially instantaneously increased, causing the short circuit strip to melt and consequently sever, thereby opening the circuit. However, modest overloads, on the order of 500 percent of rated capacity for less than ten seconds, will not ordinarily cause the short circuit strip to melt and sever. To address this problem, the heater strip in the strip and spring assembly is attached to the metal eyelet flange with a low melting point fusing alloy. The fuse is designed so that during overload conditions heat will be generated in the resistance wire coil, thereby increasing the temperature at the heater strip-metal flange junction. After a certain period of time, the heat will be sufficient to raise the solder temperature to its melting point. At this point, the spring will pull the heater strip away from the flange, thereby opening the fuse.

The above prior art construction has several deficiencies. First, the insulator and cylindrical eyelet crimped coaxially therein are hollow, and therefore the arc quenching filler material in one portion of the fuse will pass into the eyelet, increasing the heat sink mass adjacent the coil and thereby affecting the fuse rating. To overcome this filler transfer problem, the prior art requires that a washer over the end of the flange between the flange and filler material. Second, the prior art requires the additional operation of bending the coil during manufacture to assemble the coil to the metal flange. Finally, the two-piece insulator comprised of the cylinder and insulator flange is difficult to assemble.

SUMMARY OF THE INVENTION

The present invention is an improved circuit protector, or fuse, wherein the insulating assembly is modified for improved assembly and operation. In the improved construction, the improved insulating assembly includes a one-piece insulating cylinder having an integral insulating flange on one end. The flange includes a coil guide hole. The insulating assembly also includes a metal eyelet having a slotted flange on one end and, prior to assembly, a hemispherical end on the other end. The hemispherical end is formed during extrusion of the metal eyelet, and projects outward in a dome-like shape from the end of the eyelet opposite the slotted flange.

The circuit protector is assembled from a series of subassemblies. First, the cylindrical portion of the eyelet is received through a heater coil, and one end of the heater coil is arcuately passed through the slot in the flange and anchored on the eyelet The cylindrical portion of the eyelet is then threaded through the bore of the insulating cylinder such that the hemispherical end of the eyelet is inserted through and past the insulating flange, and one end of the heater coil protrudes through the guide hole. The hemispherical end of the eyelet is then crimped, retaining the insulating assembly, coil and eyelet together into a single unit. The crimping action is performed by flattening the hemispherical end, which forms an interfering lip against the outer face of the insulating flange. If necessary, a sealant is applied around the circumference of the coil protruding through the flange to seal the passage against filler material migration. A short circuit strip is then soldered to the end of the coil protruding through the insulating flange. A heater strip, having a spring connected thereto, is then soldered to the end of the coil arcuately protruding through the flange slot. These operations create the fusing subassembly.

A tube subassembly is then formed by cutting a length of tubular stock to a predetermined length, notching the side of the tube to provide protrusions on the inner surface of the tube approximately midway along its length, and then saw cutting a notch in the tube end for retaining a spring holder.

The fusing subassembly is then threaded into the tube by pulling the free end of the strip and spring assembly along the length of the tube. The protrusions on the inner surface of the tube locate the insulating flange longitudinally in the tube. The spring hook is then located into the notch in the end of the tube, and the spring is stretched over the spring hook. The insertion of the fusing subassembly sectors the interior of the tube into first and second cavities.

To complete the assembly of the fuse, the tube is held vertically, and arc quenching filler material is poured in around the short circuit strip to fill the first cavity. A washer having side tabs and a slot is threaded over the end of the short circuit strip, whereby the end of the strip is passed through the slot and folded over onto the surface of the washer. The side tabs are then folded over the sides of the tube. An end cap, having a slug of solder therein, is placed over the washer, and heated to create a solder joint between the end cap, washer and strip.

The tube is then turned, and a slotted insulative spacer is threaded over the heater strip and placed on the tube end. An end cap, having a solder slug therein is placed over the insulative spacer and tube end, and heated to reflow the solder and create a solder joint between the end cap and strip. Both end caps are then roll crimped on their ends and then notch crimps are placed in the end cap sides.

One object of the invention is to improve the structure of the fuse by eliminating the need for a separating washer to eliminate sand transmission into the eyelet.

Another object of the invention is to simplify the assembly of the fuse by eliminating the coil tail bend operation over the conductive eyelet.

Still another object of the invention is to simplify the construction and assembly of the insulator assembly.

These and other objects and advantages of the invention will become apparent from the following description and drawings.

BRIEF DESCRIPTION OF THE DRAWINGS

For a detailed description of the preferred embodiment of the invention, reference will now be made to the accompanying drawings, wherein.

BRIEF DESCRIPTION OF THE PREFERRED EMBODIMENT

Figures 1, 2, 3, 4:
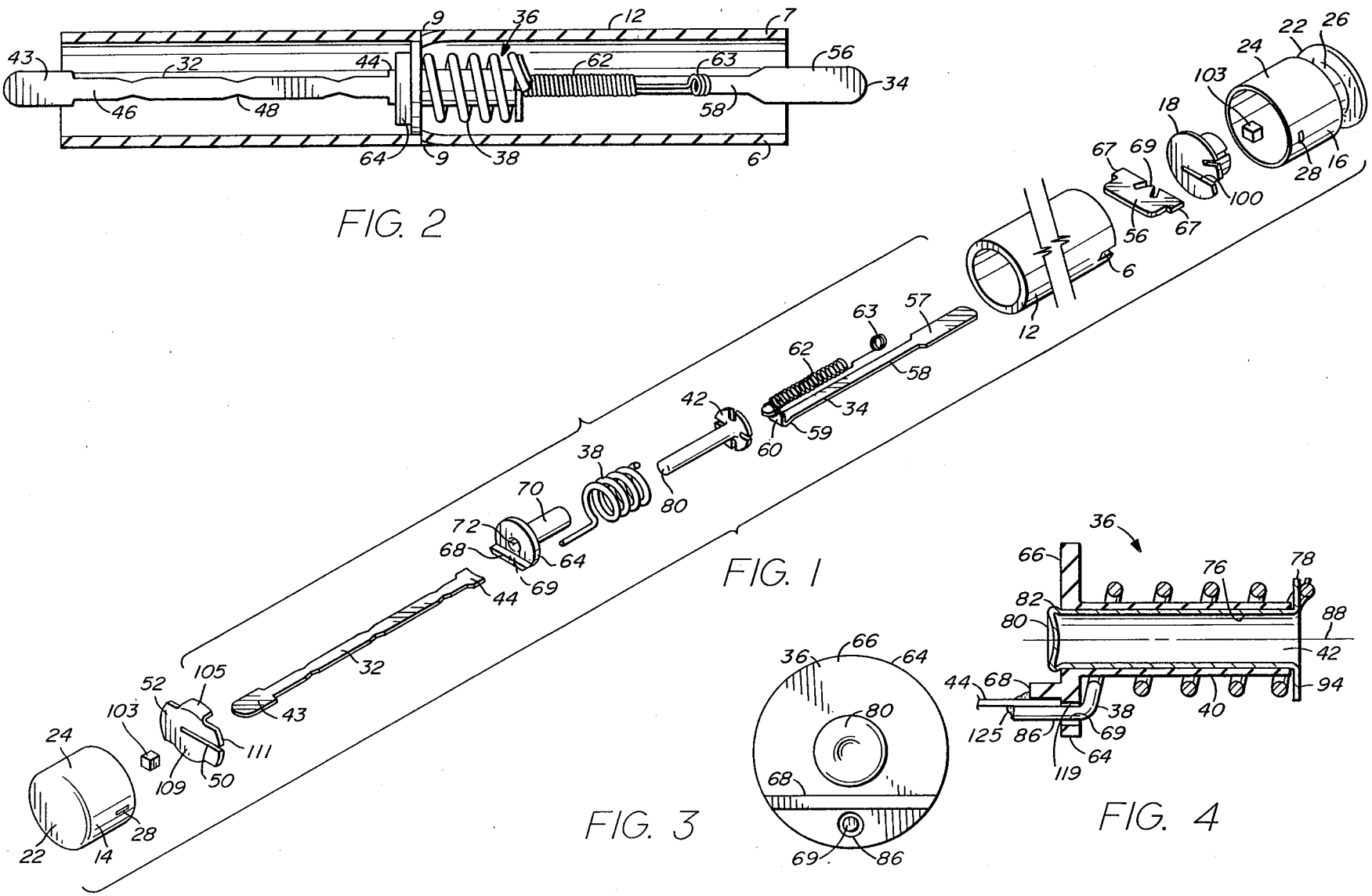
FIG. 1 is an exploded view of the fuse assembly showing the construction and interaction of the component parts.
FIG. 2 is a side view of the insulator assembly assembled into the insulator tube as shown in FIG. 1.
FIG. 3 is an end view of the insulator assembly shown in FIG. 1.
FIG. 4 is a section view of the insulator assembly shown in FIG. 1.

Referring initially to FIGS. 1 and 2, the improved fuse assembly 10 of the present invention includes a tubular sleeve body or insulator tube 12 having disposed on opposite ends thereof a first conductive end cap 14 and a second conductive end cap 16. A series of protrusions 9, preferably four protrusions, are placed on the inner surface near the mid-portion of the insulator tube 12 by pinching into the outer surface of the tube 12 to displace the interior surface of the tube 12. Within insulator tube 12 is disposed a fusing subassembly 20 extending between end caps 14, 16 to provide for the conduction and selected interruption of the electrical current passing through the fuse 10. Protrusions 9 help locate and position fusing subassembly 20 within insulator tube 12. To facilitate assembly of the fuse 10 and the conductivity at the link interface between the end caps 14, 16 and fusing subassembly 20, the inner surface of each end cap 14, 16 is loaded with a solder slug 103 prior to assembly of the fuse 10. Upon assembly, each end cap 14, 16 is heated to reflow the solder to enhance the electrical connection between the end caps 14, 16 and the fusing subassembly 20.

Figure 8:
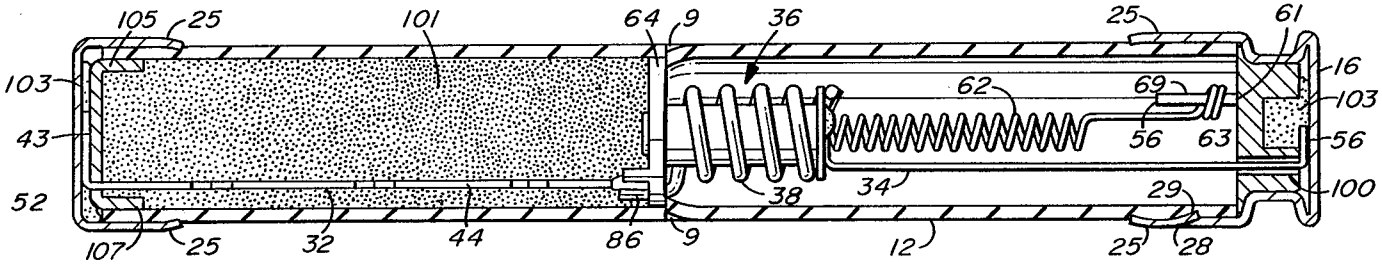
FIG. 8 is a section view of the assembled fuse assembly of FIG. 1.

Referring now to FIGS. 1, 2, and 8, the insulator tube 12 is of a one-piece construction, generally a thin insulative fiberglass reinforced thermoset polyester material. Tube 12 is preferably cut from a length of thin-wall tubular stock. The tube 12 is then pinched along its outer surface approximately midway along its length with an indenting tool to create protrusions 9 along its inner surface, and opposed slots 6, 7 are sawn into one of its ends. Conductive end caps 14, 16 are constructed from a conductive material, preferably bronze, and have a generally cylindrical outer wall 24 with a flat end 22. First conductive end cap 14 includes a conductive washer 52 which is retained on the end of insulator tube 12 by end cap 14. Second conductive end cap 16 has a groove or roll retainer 26 to meet Underwriters Labroratories Class R specifications, and retains spacer 18 and spring hanger 56 in opposed slots 6, 7 in insulator tube 12 adjacent insulative spacer 18. Spacer 18 is manufactured from an insulative material, preferably an insulative phenolic resin material such as Bakelite. End caps 14, 16 are attached to insulator tube 12 by crimps 28, typically three or four, evenly spaced about the circumference of cylindrical outer wall 24 and by a crimped lip or roll edge retainer 25 disposed around the open end of each end cap 14, 16. Roll edge retainer 25 is crimped into insulator tube 12 by knurling each end cap 14, 16. During assembly, crimps 28, in the form of protrusions, are punched into the cylindrical outer wall 24 of end caps 14, 16, causing the crimps 28 to become imbedded into the outer surface 30 of insulator tube 12, thereby assembling and retaining end caps 14, 16 on tube 12. Each crimp 28 is preferably punched such that the pointed end 29 of crimp 28 is disposed toward the adjacent end of tube 12 such that the end 29 becomes more imbedded into the exterior of tube 12 if end caps 14, 16 are attempted to be removed from the ends of tube 12.

Referring now to FIG. 2, fusing subassembly 20 includes a central insulating assembly 36 with a short circuit strip 32 and heater strip 34 electrically joined to opposite ends thereof. Referring also to FIG. 4, the insulating assembly 36 includes a cylindrical portion 40 which receives a eyelet 42. Eyelet 42 is partially disposed within cylindrical portion 40. A heater coil 38 circumscribes the outer circumference of the cylindrical portion 40 of insulating assembly 36. Fusing subassembly 20 permits interruptible transmission of electrical current through fuse 10.

Referring now to FIGS. 1, 2, and 8, short circuit strip 32 is a long thin metallic strip constructed of a fusing conductive material, preferably copper. The metallic strip includes a middle fusing portion 46 with a conducting end 43 and a coil end 44. Conducting end 43 extends through a slot 50 in a conducting washer 52. During assembly, conductive end 43 is placed through a slot 50 in washer 52 and is bent to retain the conducting end 43 of short circuit strip 32 therein. Coil end 44 is paddle-shaped. Fusing portion 46 includes a fusing neck 48 disposed at its mid-section. Fusing neck 48 is a cutout in the cross-section of fusing portion 46. One or more fusing necks 48 may be employed to ensure proper fusing characteristics of the fuse 10. Fusing necks 48 are sized to carry excess current of up to 500 percent of rated capacity for up to ten seconds without failure. However, under short circuit conditions, fusing necks 48 will quickly overheat and the fusing material will nearly instantaneously change from solid to liquid and potentially to vapor, thereby opening the circuit of the fuse 10.

Referring further to FIGS. 1, 2, and 8, heater strip 34 is a long flat metallic strip made of a heat generating conductive material, preferably copper. Short circuit strip 32 and heater strip 34 may be made from the same materials. Heater strip 34 preferably has a greater cross section than short circuit strip 32. Heater strip 34 includes a strip lead 58 having a paddle-shaped strip conductive end 57 at one end of lead 58. At the opposite end 59 of strip lead 58 is a spring loop 60. Spring loop 60 is formed by rolling the end of lead 58 into an circular shape. One end of a spring 62 is attached to spring loop 60, and the other tension end 63 of spring 62 is disposed for retention in the spring hanger 56. Spring hanger 56 is a substantially rectilinear section of black fiber, or other insulating material, disposed in opposed slots 6, 7 in the end of insulator tube 12 and includes two ears 67 and a triangular projection 69. A loop is formed by bending the last one or two turns of the spring 90 degrees. This loop is wrapped around projection 69. Other retension mechanisms, including those shown in U.S. Pat. No. 4,771,259, may be employed without deviating from the scope of the invention.

Referring now to FIG. 4, insulating assembly 36 includes barrier flange 64 colinearly disposed about one end of the cylindrical portion 40. Barrier flange 64 and cylindrical portion 40 are preferably manufactured as one continuous piece from glass filled polyethersulphone or other high temperature thermoplastic or thermoset materials. In the preferred embodiment, barrier flange 64 and cylindrical portion 40 are injection molded from a glass filed polyethersulphone. Barrier flange 64 and cylindrical portion 40 may also be made from other insulating materials, such as glass or ceramics. Barrier flange 64 is diametrically slightly smaller than the inner diameter of insulator tube 12. The face 66 of barrier flange 40 includes a mounting alignment ridge 68. Mounting alignment ridge 68 is a rectangular ridge protruding from, and projecting chordially across, face 66. A coil guide hole 69 is disposed through flange 64 between ridge 68 and the outer diameter of the flange 64. Cylindrical portion 40 is preferably disposed normal to flange 64 and extends from flange 64 on the side opposite ridge 68. Cylindrical portion 40 has an outer diameter sized so as to be received within heater coil 38. The inner diameter of cylindrical portion 40 is sized to accept eyelet 42 as further described below.

Figure 7:
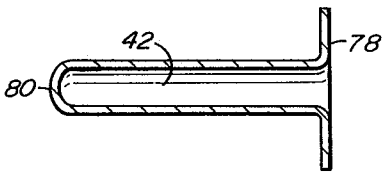
FIG. 7 is a section view of the ferrule shown in FIG. 1 prior to assembly tube and the insulator assembly.

Eyelet 42 is constructed from an extrudable conductive material, preferably brass, and has a cylindrical eyelet or sleeve 76 with a flange 78 at one end. Sleeve 76 is extruded from a piece of sheet stock. Flange 78 is a stamped portion, flange 78 and sleeve 76 being formed of one continuous piece of material. As best shown in FIG. 7, the other end of sleeve 76 is a hemispherical, or dome-shaped, sleeve end 80 having the form of a protrusion prior to assembly. Upon assembly into cylindrical portion 40, sleeve end 80 is flattened as shown in FIG. 4, cylindrical portion 40 as shown in FIG. 4.

Figure 6:
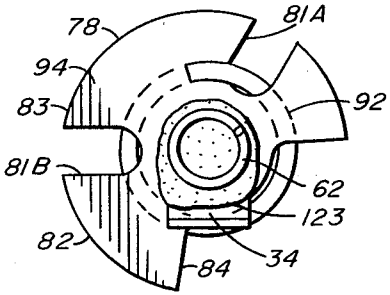
FIG. 6 is an end assembly view of the fusing assembly shown in FIG. 1.
Figure 5:
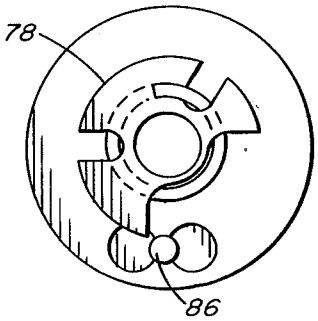
FIG. 5 is an end view of the ferrule and insulator cylinder and flange shown in FIG. 1.

As best shown in FIGS. 5 and 6, flange 78 is generally circular, having three slots 81*a*, 81*b*, 84 disposed approximately 120 degrees apart. First and second slots 81*a*, 81*b* are generally longitudinal protrusions extending inward from outer circumference 83. Quadrant slot 84 is a removed 90 degree section of flange 78. Quadrant slot 84 and slots 81*a*, 81*b* interact with heater coil 38 to anchor coil 38 onto insulating assembly 36 during assembly.

Referring now to FIGS. 1, 2, 4, 6, and 8, heater coil 38 is a length of resistance wire, preferably a copper/-nickel alloy, wound in a coil configuration. The resistance wire material must be capable of developing heat in response to current flows therethrough in excess of rated current. The inner diameter of heater coil 38 is sized to slidingly receive cylindrical portion 40. As best shown in FIG. 4, heater coil 38 includes a tail end 86 which is a short length of wire substantially parallel to, and offset from, the axis of heater coil 38. Tail 86 protrudes through the guide hole 69 in flange 64. Different coil wire cross sections are used for different amperage rated fuses. Lower amperage fuses use a smaller cross section wire. Where the coil cross-section is small in comparison to the size of hole 69, an adhesive is placed around coil tail 86 to seal hole 69. At the opposed end of heater coil 38 is a radial end 92 which is engageable with eyelet 42 through quadrant slot 84. Coil radial end 92 engages flange 78 through quadrant slot 84 to be retained on the outer surface 94 of flange 78. Where the size of heater coil 38 permits, coil radial end 92 may protrude back through one of slots 81*a*, 81*b* for further retention as shown in FIG. 6.

Fuse 10 is assembled as a series of subassemblies. To assemble fusing subassembly 20, eyelet 42 is placed through heater coil 38 and rotated approximately one quarter turn to engage coil radial end 92 through quadrant slot 84 and on to flange outer surface 94. Alternatively, radial end 92 may be further tucked into one of the slots 81*a*, 81*b*. The sleeve 76 of eyelet 42 is then inserted through the inner diameter of cylindrical portion 40 while heater coil 38 slidingly engages the outer surface 66 of flange 64 and tail 86 is inserted into hole 69. Adhesive 119 may be located in alignment hole 69 to seal the passage. The end 80 of sleeve 76 is then flattened, forming roll crimp 82 which locks eyelet 42 and insulating assembly 36 together. By assembling coil radial end 92 through quadrant slot 84, the step of bending the heater coil 38 end around the outer circumference of the flange 78 and onto outer surface 94 is eliminated. Instead, a simple twisting motion engages the heater coil 38 and eyelet 42. Further, the one-piece combination of a barrier flange 64 and cylindrical portion 40 eliminates the step of holding those two pieces in alignment for the insertion of eyelet 42 therethrough.

To complete the assembly of fusing subassembly 20, one end of spring 62 is disposed on the end of heater strip 34, and spring loop 60 is formed over the end of spring 62 by bending the end of heater strip 34. Spring loop 60 is positioned on the outer surface 94 of flange 78 adjacent coil radial end 92 and a low melting point fusing alloy 123, preferably a tin/bismuth alloy solder which changes from solid to liquid phase at approximately 284° F., is then applied to bond the flange 78, coil radial end 92, spring loop 60 and spring 62 together. Short adjacent coil tail 86 and hand soldered together with a lead tin solder 125. The insulator tube 12, as a second subassembly, is prepared by punching protrusions 9 therein approximately midlength to tube, and cutting opposed slots 6, 7 in one end.

The fusing subassembly 20 is now loaded into insulator tube 12 by threading strip conductive end 57 into the end of tube 12 opposite slots 6, 7, and then pulling the fusing subassembly 20 through the insulator tube 12 until insulator assembly 36 engaged protrusions 9.

The insulator tube 12, with the fusing subassembly 20 loaded therein, is then vertically disposed and packed with arc quenching filler 101. The filler is preferably 99.8% silica, having American Foundry Society Grain Fineness 35*F*, obtainable from Weldron Silica Division of Del Monte Properties Co., Catalog No. 4060 "silica sand," or, from Ottawa Silica Co., under the name "sawing sand." However, Terra-alba, stone sand, ceramics, aluminum sulfate, marble powder and other arc quenching fillers may be used without deviating from the scope of the invention. Likewise, those skilled in the art may use oils, air or even a vacuum adjacent the short circuit strip to practice the invention. Conducting end 43 is now inserted through slot 40 in end washer 52, and washer 52 is then placed on the end of the tube 12. Washer alignment walls 105, 107, which are arcuate flaps projecting downward from the surface of washer 52, help locate washer 52 within insulator tube 12. Washer 52 also includes side projections 109, 111, shown in FIG. 1, which extend outward from washer 52 between flaps 105, 107. Fusing link conducting end 43 is then folded over to press against the outer surface of washer 52. End cap 14, including solder slug, is then placed over washer 52 and the end of insulator tube 12, folding projections 109, 111 down over tube outer wall 30 and the end is heated to cause the solder slug 103 to reflow and create a solder joint between conducting end 43, washer 52 and cap 14.

The insulator tube 12 is then turned, and insulative spacer 18 is located on the opposite end of the insulator tube 12 by threading strip conductive end 56 through insulator slot 100. Air is contained in this cavity of the insulator tube 12. End cap 16, including the solder slug, is then placed over insulator space 18 and the adjacent end of insulator tube 12, and heated to reflow the solder slug to create a solder joint between end cap 18 and strip conductive end 56. The edge of each end cap 14, 16 is then roll crimped to form roll edge retainer 25, and crimps 28 are punched into the end cap outer walls 24. The interior of tube 12 is thus substantially sealed from the exterior ambient environment.

It should be appreciated that this fuse construction eliminates the need for a washer to prevent the passage of sand through the inner diameter of flange 12, and the heater coil 38 is mechanically interferingly engaged with the eyelet 42 through quadrant slot 84. This eliminates the manufacturing step of bending heater coil 38 to eyelet 42 during assembly.

Although a preferred embodiment of the invention has been described, the invention may take form in various parts or combinations of parts without deviating from the scope of the invention.

I claim:

1. A fuse, comprising:

a tubular insulating body having a first end and a second end, a hollow cylindrical insulator having first and second cylindrical ends, an insulator barrier flange disposed radially about said first cylindrical end and having a coaxial aperture therethrough;

a conductive metal eyelet having a closed sleeve end portion and a conductive flange portion;

said sleeve portion received within said hollow cylindrical insulator such that said conductive flange portion abuts said second cylindrical end, said closed end portion crimped over said barrier flange;

a resistance wire coil having a tail end and a radial end disposed around said cylindrical insulator between said conductive flange and said barrier flange.

said barrier flange further including a coil aperture therethrough;

said tail end projecting through said coil aperture, said radial end disposed on said conductive flange opposite said second cylindrical end;

the assembly of said hollow cylindrical insulator, said barrier flange, said eyelet and said coil forming an insulator assembly;

said insulator assembly disposed in said tube to sector said tube into first and second cavities;

a heater strip having a conductive end and an spring loop end;

a spring having one end thereof retained within said spring loop end;

said spring loop end in electric conductive engagement with said coil radial end adjacent said conductive flange;

a spring tensioning means for engaging said spring in tension in said tubular insulating body;

said spring engaged in tension between said spring loop and said spring tensioning means;

a short circuit strip having a coil end and a conducting end;

said coil end in electrically conductive contact with said coil tail; and electrically conductive end caps having solder slugs therein disposed on said first and second ends of said tubular insulating body, said heater strip disposed in said first cavity and having said heater strip conductive end disposed in electrically conductive engagement with said end cap on said first end and said short circuit strip disposed in said second cavity and having its conducting end disposed in electrically conductive engagement with said end cap on said second end.

2. The fuse of claim 1, wherein said tubular body includes locating protrusions, which interferingly engage said barrier flange in said tubular body.

3. The fuse of claim 1, wherein said hollow cylindrical insulator and barrier flange are constructed as one continuous section.

4. The fuse of claim 1, wherein said eyelet flange includes a quadrant slot, and said coil radial end arcuately protrudes through said slot.

5. The fuse of claim 1, wherein said second cavity is packed with arc quenching filler.

6. The fuse of claim 1, wherein said closed sleeve end portion is a hemispherical cap crimped to form a circumferential crimp roll.

7. The fuse of claim 1, wherein said heater strip spring loop is soldered to said conductive flange with a fusing alloy having a melting point of approximately 284° F.

8. The fuse of claim 1, wherein said short circuit strip includes at least one necked down portion.

9. The fuse of claim 1, wherein said barrier flange and said hollow cylindrical cylinder are injection molded from glass filled polyethersulphone.

10. The fuse of claim 1, wherein said conductive metal eyelet is constructed from brass.

11. An improved insulator assembly for a dual element line fuse, comprising;

a cylindrical insulator having a first end and a second end;

a circular barrier flange having concentric and offset apertures therethrough;

a conductive cylindrical eyelet having a sleeve portion terminating in a closed end and an open end, said open end further including a conductive flange radially disposed thereon;

said cylindrical insulator receiving said sleeve portion and having said conductive flange abutting said cylinder first end and said closed end protruding through said cylinder beyond said second end;

said closed end further disposed through said concentric aperture;

said closed end including an engagement means for maintaining said cylindrical insulator and said barrier flange on said sleeve portion; and a conductive coil circumferentially engaged about said cylindrical insulator, said coil further including a radial end disposed on said conductive flange and a tail end disposed through said offset aperture.

12. The improved insulator assembly of claim 11, wherein said eyelet closed end is a hemispherical dome flattened to create a circumferential crimp on the barrier flange about the concentric aperture.

13. The improved insulator assembly of claim 11, wherein said barrier flange and hollow cylindrical insulator are one continuous piece.

14. The improved insulator assembly of claim 13, wherein said barrier flange and hollow cylindrical insulator are injection molded.

15. The improved insulator assembly of claim 11, wherein said conductive flange includes a quadrant slot therein.

16. The improved insulator assembly of claim 15, wherein said coil radial end is disposed through said quadrant slot.

17. A dual element line fuse comprising:

a housing having an insulative body with conductive ends, said insulative body forming a compartment between said conductive ends;

an insulative divider having a first aperture therethrough dividing said compartment into first and second cavities;

a conductor extending through said compartment between said conductive ends for providing an electrical connection between said conductive ends, said conductor including a first conductive strip disposed in said first cavity and a coil and second conductive strip disposed in said second cavity;

a conductive connector disposed in said second cavity and extending through said first aperture to close said first aperture and attach said conductive connector to said insulative divider, said coil and second conductive strip having ends soldered together on said conductive connector, said solder having a predetermined melting point;

said insulative divider insulating said conductive connector from the remainder of said coil; and the other end of said coil extending through a second aperture in said divider for connection to said first conductive strip.

18. The dual element line fuse of claim 17, wherein said conductive connector includes a flange having a portion thereof inserted between the last two windings of said coil whereby said soldered end is disposed on one side of said flange and the remainder of said coil is disposed on the other side of said flange without increasing the diameter of said coil.

19. The dual element line fuse of claim 18, wherein said conductive connector includes a shaft portion extending from one side of said flange, said shaft portion passing through said windings of said coil, said flange has the general shape of a that of said coil.

20. The dual element line fuse of claim 17 further including a spring means having one end soldered to said second conductive strip and said conductive connector and the other end connected to said conductive end in said second cavity whereby said spring means pulls said second conductive strip from engagement with said coil upon said solder melting.

21. A method of making a fuse, comprising the steps of:

providing a eyelet having a sleeve with a closed end and an open end with a radial flange having a quadrant slot therein radially disposed thereon; providing a coil having a radial end and a longitudinal coil tail;

threading said coil over the eyelet and rotating the eyelet and coil with respect to each other to cause the coil radial end to pass through the quadrant slot to retain the coil on the eyelet;

inserting the sleeve closed end into a hollow cylindrical insulator and the sleeve closed end and coil tail through a circumferential radial flange;

crimping the closed end over said radial insulator flange;

attaching the spring loop of a strip and spring assembly to the radial flange with a low melting point fusing alloy;

soldering one end of a short circuit strip to the coil tail;

cutting a length of insulator tubing and cutting opposed spring retainer notches in one end;

crimping the insulator tube to form a series of circumferential projections about its inner circumference;

pulling the strip and spring assembly through said tube until the insulator flange engages the protrusions, and the spring is located adjacent the opposed spring retainer slots;

placing a spring hanger in the opposed slots in the insulator tube;

tensioning the spring into tensile engagement with the spring hanger;

packing arc quenching filler around the short circuit strip;

threading the short circuit strip through a conducting washer, and folding the end of the short circuit strip against the washer;

placing the conductive washer over one end of the insulator tube;

placing a solder slug in the end caps;

locating one end cap over the conductive washer and the adjacent end of said tube;

heating the end cap to reflow the solder creating a solder joint between the short circuit strip, the conductive washer and the end cap;

threading the heater strip through an insulating spacer;

locating the insulating spacer on the end of the tube adjacent the spring hanger;

folding the heater strip against the outer surface of the insulative spacer;

placing the remaining end cap over the insulating spacer and adjacent tube end and heating the end cap to reflow the solder to create a solder joint between the heater strip and second end cap; and staking the end caps into gripping engagement with said tubular body;

22. The method of making the fuse of claim 21, wherein said step includes rolling a crimp into the edge of the end caps.

23. The method of making the fuse of claim 21, wherein said step includes stamping crimps into the sides of the ends caps.

* * * * *